United States Patent [19]

Dworsky et al.

[11] 4,101,850

[45] Jul. 18, 1978

[54] UHF ISOLATOR USING STACKED CONDUCTOR SHEETS

[75] Inventors: Lawrence Noah Dworsky, Coral Springs; Jeffery Alden Whalin, Hialeah, both of Fla.

[73] Assignee: Motorola, Inc., Schaumburg, Ill.

[21] Appl. No.: 788,398

[22] Filed: Apr. 18, 1977

[51] Int. Cl.[2] ..... H01P 1/36

[52] U.S. Cl. ..... 333/24.2; 333/84 R

[58] Field of Search ..... 333/1.1, 24.1, 24.2

[56] References Cited

U.S. PATENT DOCUMENTS 3,835,420 9/1974 Orime et al. ..... 333/24.2

4,016,510 4/1977 Hodges et al. ..... 333/24.2

*Primary Examiner*—Paul L. Gensler

*Attorney, Agent, or Firm*—Margaret Marsh Parker; James W. Gillman

[57] ABSTRACT

An isolator for ultra-high frequencies provides a broadband characteristic by simulating a carved-out copper block with stacked copper laminates. Internal structures are formed by photolithographic processing of the copper sheets. Ferrite elements and a unilateralizing resistor are captivated within the stack of sheets which provides inductance, capacitance and optimal ground return paths, as well as heat sinking for the resistor. No external matching network or tuning is required.

14 Claims, 5 Drawing Figures

UHF ISOLATOR USING STACKED CONDUCTOR SHEETS

BACKGROUND OF THE INVENTION

This invention relates to the field of isolators for RF circuits and, more particularly, to an isolator having circuitry and "package" integrally formed.

Two types of isolation devices have been developed and used for providing one-way signal paths, namely, terminated circulators and resonance isolators. Circulators, typically, have three or more ports, with a minimum of signal attenuation between signals entering at a first port and leaving at a second, or entering at the second port and leaving at a third, but great attenuation in signal between the second port and the first. Thus, with the proper impedances at each port, a non-reciprocal device is provided. Also known are resonance isolators which are two-port devices utilizing the gyromagnetic resonance of a ferrite material, but these are efficient isolators only for a very narrow band of frequencies at resonance of the gyromagnetic material. Since the gyromagnetic resonance of ferrites is very temperature sensitive, this type of isolator requires careful control of power loss dissipated in the ferrite to prevent change of resonant frequency, or even increasing the ferrite temperature beyond the Curie point where the material becomes simply paramagnetic.

In a U.S. patent application, Ser. No. 682,686 now U.S. Pat. No. 4,016,510, assigned to the same assignee as is the present invention, a broadband isolator is disclosed. In this patent application, two conductors or loops with one end grounded are placed within a static magnetic field with their main axes perpendicular to each other. Also within the field and placed adjacent to the loops or lines are one or two ferrite discs, the field being normal to the planes of the discs and to the axes of the conductors. An electromagnetic shield box wraps around the conductors and discs and a high permeability return path is provided. A unilateralizing resistive element is coupled between the input and output terminals. This resistive element, being essentially nonreactive, provides the broadband response characteristic.

A practical model of such a broadband isolator for much higher frequencies, however, must take into account additional factors. For example, the free space inductance of the loops or lines is not negligible, therefore the resistive elements cannot be located at the ideal points in the network. Also, the capacity between the loops or lines becomes appreciable and must be allowed for. The effect on the network of the "package" or shield box can no longer be ignored, e.g., ground paths may become inductances and "good" grounds no longer are satisfactory. The ideal structure then appears to be a solid conductive block, carved out and formed to provide the necessary circuit elements, and requiring no external elements.

SUMMARY OF THE INVENTION

It is an object of the invention to provide a broadband isolator for the higher UHF frequencies.

It is a particular object to provide an essentially ideal structure, using inexpensive, easily fabricated elements with a minimum of external components.

These and other objects are provided by an isolator constructed in accordance with the invention by creating the equivalent of a solid block of conductive material as copper by stacking a multiplicity of thin sheets of the material. Each sheet is etched, as by photolithographic processes, to form the appropriate cavities. Insulating layers are formed on certain portions of certain sheets, also by photolithographic processes. Ferrite discs and unilateralizing resistor are captivated within the stack.

DETAILED DESCRIPTION OF A PREFERRED EMBODIMENT

Figure 1:
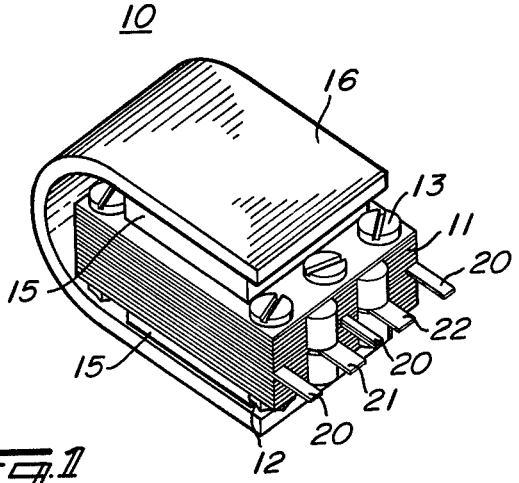
FIG. 1 is an overall, perspective view of an assembled isolator according to the invention.
Figure 2:
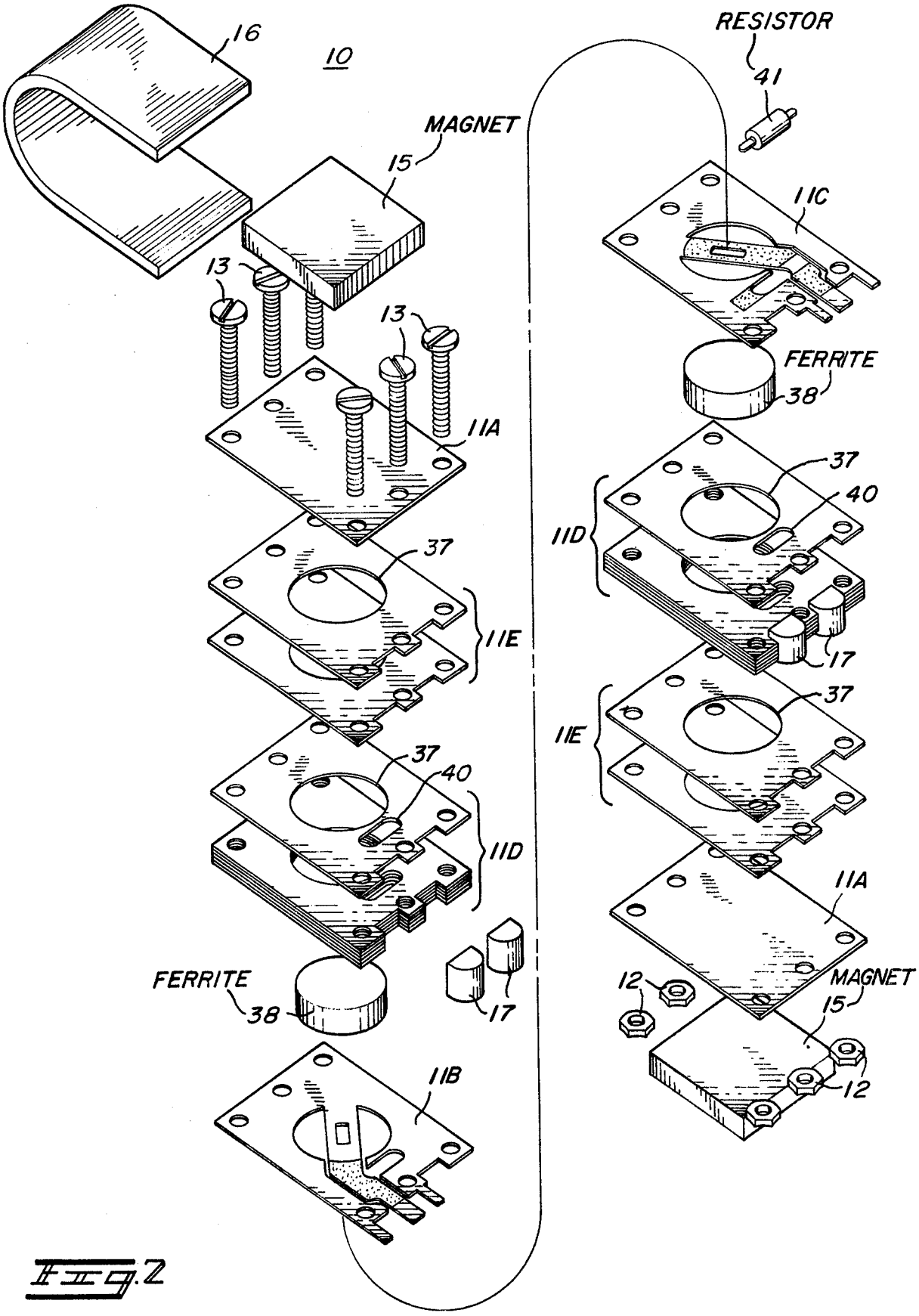
FIG. 2 is an exploded view of the embodiment of FIG. 1.

The physical structure of an isolator 10 in accordance with the invention will be best understood by comparing FIGS. 1 and 2, FIG. 1 being a completed assembly of the individual elements shown in FIG. 2. In FIG. 1 will be seen a block 11 made up of laminations or sheets 11A to 11E of FIG. 2, aligned and fastened together by small nuts 12 and bolts 13. The sheets 11 are planar members, preferably formed by photolithographic processes from sheets of 0.005 inches copper sheet. It is to be noted that nuts 12 and bolts 13 are merely exemplary means of retaining the sheets in block 11 in alignment and tight contact. Two magnets 15 are placed adjacent the top and bottom of the block of sheets 11, the magnetic structure being such that the field is essentially normal to the plane of each sheet 11A to 11E. The magnets must be of a size to provide a uniform field of sufficient cross-section for satisfactory operation of the isolator. A steel or iron keeper 16 may be placed around the structure to provide a high permeability return path. Four wedges 17, preferably of a resilient, low loss, material such as is known commercially as Teflon, prevent the leads 20, 21 and 22 from shorting together, help protect the isolator and the leads from damage due to bending, vibration and soldering heat, and are dimensioned to make the input and output appear as the desired transmission line, in this case, 50 ohm strip transmission line.

The individual laminations or sheets 11A–11E may be clearly seen in FIG. 2. Two solid sheets 11A serve as top and bottom and complete the shielding of the block. Two sheets 11B and 11C are in the center and together comprise the lines 23 and 24, resistor contact areas 25, capacitance 26 (FIG. 3) and portions of capacitances 27 and 28, resistors 30 and 31, inductances 33 and 34, a portion of the ground return path, the ground leads 20 and input and output leads 21 and 22. The sheets 11B and 11C will be described in detail in relation to FIG. 5. Each of a group of sheets 11D contains two apertures, a large one 37 which is dimensioned to provide a close fit for one of two ferrite discs 38, a smaller one 40 which will fit over a resistor 41 lengthwise. It is to be noted that while the group of sheets 11D shown in FIG. 2 includes two sub-groups of six sheets each, a single sheet formed of thicker material could replace either of the sub-groups of sheets 11D. In any case, the number of apertures 40 is determined by the thickness of the resistor 41. In this embodiment, the resistor 41 is a one-eighth watt resistor, approximately 65 mils thick and it is captured by the fourteen apertures 40 in the sheets 11B, 11C and 11D. Each of a group of sheets 11E has only the aperture 37. The ferrite discs 38 in this embodiment are 40 mils thick and each is contained within one group of eight apertures 37 in the sheets 11D and 11E. The elements shown in FIG. 2 should be pre-dried, then assembled in a dry atmosphere and sealed with any suitable moisture-proof sealant for maximum reliability.

Figure 4:
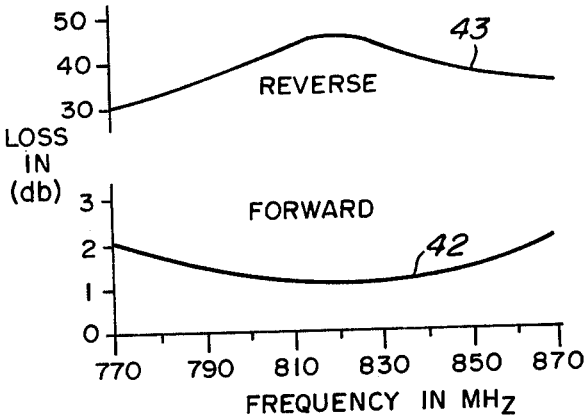
FIG. 4 is a frequency response chart showing a comparison of typical insertion loss and reverse loss.
Figure 3:
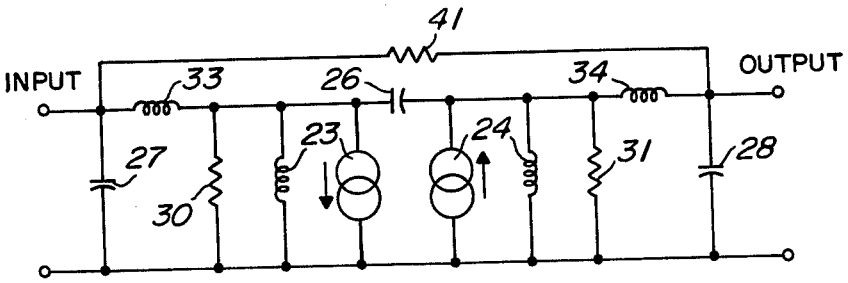
FIG. 3 is an equivalent circuit of the isolator.

The equivalent network of the isolator is shown in FIG. 3 and the elements of the network will be discussed in regard to FIG. 5. FIG. 4 shows typical curves 42 and 43 of forward and reverse loss respectively, indicating the broad-band characteristic and a maximum loss differential of approximately 45 db.

Figure 5:
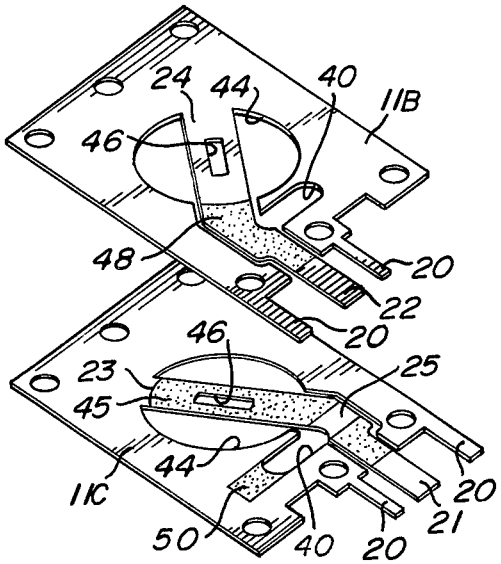
FIG. 5 is a detail from FIG. 2, showing the two key sheets.

In FIG. 5, the two center sheets 11B and 11C are shown, and enlarged still more for greater clarity. Each sheet includes an aperture 44 which is similar to the apertures 37, but having across the center one of the conductors or inductive lines 23 and 24. Each of the inductive lines 23 and 24 may be considered as an inductance and a current source. The sheets 11B and 11C as etched are identical and the insulated areas (described hereinbelow) are identical but one sheet is inverted at the time of assembly, making the line 23 lie perpendicular to the line 24 in the completed assembly. The lines 23 and 24 are insulated from each other by the insulating coating area 45 which is applied to one or both of the lines. The preferred insulating material is a photo resist known commercially as Riston, Type 211. Since the area 45 and the other insulating areas described hereinbelow can be defined photographically as are the etched areas, manufacturing costs can be greatly reduced while maintaining a high degree of accuracy in processing.

The central area of each line 23 and 24 has an aperture 46 which greatly reduces the line-to-line coupling capacity 26 with only slight increase in inductance since current is concentrated at the edges of each line. The free space inductance of the lines 23 and 24 form the inductances 33 and 34. The resistors 30 and 31 (FIG. 3) are made up of the resistance of the lines 23 and 24 and the length of the leads from the lines, and an area 48 of insulating material insulates each lead 21 and 22. The insulating area 48 is in two parts, one on the inner side of the sheet 11B or 11C, extending from the resistor contact areas 25 to the edge of the block of sheets, the other on the outer side of the sheet and extending from the non-grounded end of the line 23 or 24 to the edge of the block. The resistor 41, having very short leads, is retained within the apertures 40, and the resistor leads are captured between the sheets 11B and 11C, against contact areas 25. Thus, an area 50 of insulation is required on each sheet 11B and 11C opposite the contact area 25 of the other of the sheets 11B and 11C. In other words, when the isolator is fully assembled, one lead of the resistor 41 makes contact with only one of the sheets 11B and 11C, the other lead makes contact only with the other of the sheets. Since the resistor 41 is heat-sinked by the entire block of conductive material, the power handling capability of the resistor is greatly extended beyond the rating. The sheets 11A, 11D, 11E and all areas of the sheets 11B and 11C which are in electrical contact with other sheets, combine to form the ground return path and shielding for the isolator. The capacitances 27 and 28 (FIG. 3) are a result of the capacitance between the insulated leads 21 and 22 and the adjacent areas of the ground paths.

Thus there has been provided, with inexpensive and easily reproduced sheets, the equivalent of a "cooper block" comprising a near ideal, but almost impossible to attain, isolator for high frequencies. Various variations and modifications of this invention are, of course, possible and it is contemplated to include all such as fall within the spirit and scope of the appended claims.

What is claimed is:

1. An improved broadband two-port isolator for use in high frequency electronic apparatus and comprising in combination:

gyromagnetic members;

resistor means;

a plurality of substantially parallel, contiguous planar members, each member having essentially the same dimensions in the major plane, being formed of a conductive material, at least some of the members having apertures formed therein for receiving the gyromagnetic means and the resistor means;

insulating means affixed to two of the planar members for insulating portions of each of the two members from adjacent planar members; and magnetic means placed adjacent the planar members for producing a static magnetic field in a direction essentially perpendicular to the planes of the planar members, the magnetic field being essentially uniform in the gyromagnetic means; a first end of the resistor means electrically contacting one of the said two planar members and a second end of the resistor means electrically contacting the other one of the said two planar members;

and wherein the two of the planar members comprise inductive lines between the gyromagnetic members, having the axis of one inductive line perpendicular to the axis of the other inductive line, and also wherein predetermined portions of the planar members comprise tuning elements for said inductive lines.

2. An improved broadband two-port isolator as in claim 1 wherein the gyromagnetic members comprise ferrite discs.

3. An improved broadband two-port isolator according to claim 1 wherein the planar members are formed from copper sheet.

4. An improved broadband two-port isolator according to claim 1 wherein the planar members are formed by a lithographic process.

5. An improved broadband two-port isolator according to claim 1 wherein the areas of the insulating means are defined by a photolithographic process.

6. An improved broadband two-port isolator according to claim 1 and wherein the planar members comprise shielding means for the isolator.

7. An improved broadband two-port isolator according to claim 1 and further including means for providing a high permeability return path for the magnetic field.

8. An improved broadband two-port isolator for use in high frequency electronic apparatus and comprising in combination:

gyromagnetic means;

resistor means having first and second terminal means;

a plurality of substantially parallel, contiguous planar members, each member composed of a conductive material and wherein a first one of said planar members comprises a first inductance means, a first contact portion and a first portion of a first capacitance means, and has a first aperture for receiving the resistance means and a second aperture having dimensions essentially equal to the dimensions of the gyromagnetic means, a second one of said planar members comprises a second inductance means, a second contact portion and a first portion of a second capacitance means, and has a first aperture for receiving the resistance means and a second aperture having dimensions essentially equal to the dimensions of the gyromagnetic means, the axis of the first inductance means being positioned perpendicular to the axis of the second inductance means, the terminal means of the resistance means being positioned between the first and second planar members, for having the first terminal means in electrical contact with the contact portion of the first planar member and the second terminal means in electrical contact with the contact portion of the second planar member, others of the planar members have first apertures therein for receiving the gyromagnetic means, a predetermined number of said other members have second apertures therein for receiving the resistance mean;

first insulator means positioned between the first and second planar members for insulating the first inductance means from the second inductance means;

second insulating means positioned between the first and second planar members for insulating the first contact portion from the second planar member and the second contact portion from the first planar member;

third insulator means positioned to insulate the first portions of the first and second capacitance means from adjacent areas of the others of the planar members;

shielding means for providing electrostatic shielding for said planar members;

magnetic means positioned to provide a static magnetic field perpendicular to the planes of said planar members.

9. An improved broadband two-port isolator as in claim 8 wherein the gyromagentic means are ferrite discs.

10. An improved broadband two-port isolator according to claim 8 and wherein the planar members are formed by a photolithographic process.

11. An improved broadband two-port isolator according to claim 8 wherein the insulating means are formed on the planar members by a photolithographic process.

12. An improved broadband two-port isolator according to claim 8 and wherein the planar members are formed of copper sheet.

13. An improved broadband two-port isolator according to claim 8 and wherein the shielding means are formed of copper sheet.

14. An improved broadband two-port isolator according to claim 8 and wherein the shielding means are formed of portions of the planar members.

* * * * *